US009119981B2

(12) United States Patent
Fernandez

(10) Patent No.: US 9,119,981 B2
(45) Date of Patent: Sep. 1, 2015

(54) FIREFIGHTING APPARATUS

(76) Inventor: Juan Abel Fernandez, Hollis, NY (US)

( * ) Notice: Subject to any disclaimer, the term of this patent is extended or adjusted under 35 U.S.C. 154(b) by 583 days.

(21) Appl. No.: 12/756,728

(22) Filed: Apr. 8, 2010

(65) Prior Publication Data

US 2011/0247841 A1 Oct. 13, 2011

(51) Int. Cl.

| | |
|---|---|
| ***A62C 31/00*** | (2006.01) |
| ***F42B 12/50*** | (2006.01) |
| ***A62C 3/02*** | (2006.01) |

(52) U.S. Cl.

CPC ..... *A62C 31/00* (2013.01); *A62C 3/025* (2013.01)

(58) Field of Classification Search

CPC ..... A62C 27/00; A62C 3/04; A62C 3/06; A62C 5/02; A62C 31/00; A62C 3/025; E21B 35/00; F42B 12/50; F42B 5/145; A01M 9/00; F41H 9/02; F41H 9/10

USPC ..... 169/52, 24; 102/370; 124/4–9

See application file for complete search history.

(56) References Cited

U.S. PATENT DOCUMENTS

| | | | | | |
|---|---|---|---|---|---|
| 636,122 | A | * | 10/1899 | Eades et al. | 212/203 |
| 1,928,909 | A | * | 10/1933 | Reasor | 169/36 |
| 2,359,573 | A | * | 10/1944 | Mackay | 169/36 |
| 3,833,064 | A | * | 9/1974 | Ranney, Jr. | 169/52 |
| 5,641,024 | A | * | 6/1997 | Lopez Alvarez | 169/52 |
| 5,746,396 | A | * | 5/1998 | Thorton-Trump | 244/134 R |
| 6,336,594 | B1 | * | 1/2002 | Bader et al. | 239/54 |
| 2005/0139363 | A1 | * | 6/2005 | Thomas | 169/30 |

* cited by examiner

*Primary Examiner* — Arthur O Hall
*Assistant Examiner* — Chee-Chong Lee
(74) *Attorney, Agent, or Firm* — Ariel S. Bentolila; Bay Area IP Group LLC

(57) ABSTRACT

An apparatus includes a capsule for transporting a quantity of water to a vicinity of a fire and for carrying the water to the fire, where the capsule breaks open on contact with the fire to release the water. A spring-loaded arm comprising a capsule receptacle in which capsules are loaded hurls one or more capsules at a time to the fire. The spring-loaded arm is rotatable for aiming. The capsule receptacle includes a high powered light for indicating where water capsules will be hurled. A height-adjustable platform includes a scissor mechanism for adjusting a height of the spring-loaded arm.

6 Claims, 5 Drawing Sheets

FIREFIGHTING APPARATUS

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to firefighting. More particularly, the invention relates to a device and method for quickly and efficiently combating fire using water capsules.

BACKGROUND OF THE INVENTION

The present invention relates to fighting fires using water capsules. Current methods of fighting fires include using hoses to spray water on the fire or using aircraft (e.g., airplanes and helicopters) to drop large amounts of water on the fire. However, using these methods the water does not fall with efficiency or capacity. When it rains water comes down to the earth in the form of drops, which gives the water mass to placate fire. However, when water is forced through the air (i.e., through a hose or from an aircraft), the water expands in the air and the temperature of the air may cause part of the water to evaporate into the air. This expansion and evaporation of the water can cause the water to have insufficient power to combat the fire. It is therefore an objective of the present invention to provide a means and method to deliver water to a specific place while generally preventing the water from expanding and evaporating in the air.

In view of the foregoing, there is a need for improved techniques for providing means and methods for fighting fires that carry the water to the fire in capsules.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
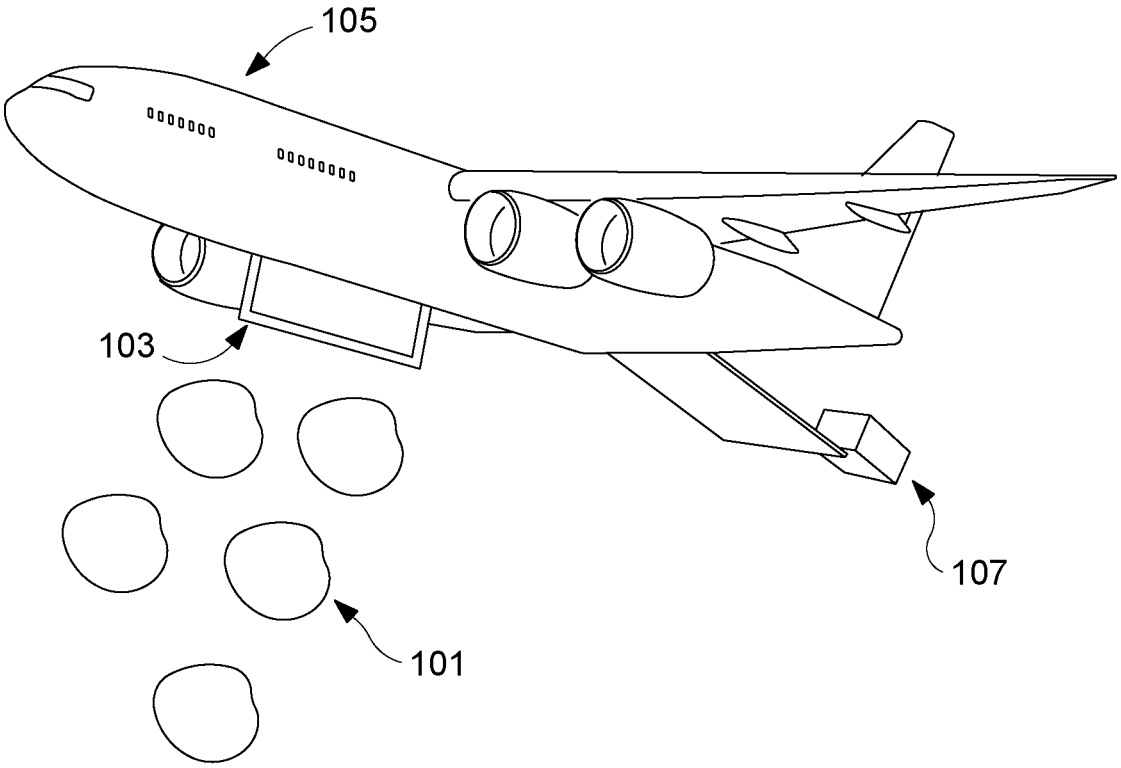
FIG. 1 is a diagrammatic side view of an exemplary fire fighting system for aircrafts, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a capsule which can transport water and carry the water to an objective (e.g., forest fire or structure fire). In preferred embodiments this capsule also breaks open when it touches the objective. Water carrying capsules in preferred embodiments may be made of various materials such as, but not limited to, rubber similar to balloons, plastics, etc. The body of the water capsule in various embodiments may comprise various different designs for example, without limitation, an American eagle, the name of the product, instructions, metallic colors, etc.

FIG. 1 is a diagrammatic side view of an exemplary fire fighting system for aircrafts, in accordance with an embodiment of the present invention. In the present embodiment, water capsules 101 are dropped from an exit door 103 in an aircraft 105. A large number of water capsules 101 are loaded onto aircraft 105 through a loading door 107. This fire fighting system has the facility to combat fire in large areas such as, but not limited to, forests with much more efficiency and precision than current methods. In the present embodiment, aircraft 105 is a large cargo plane; however, those skilled in the art, in light of the present teachings, will readily recognize that various different types of aircraft may be used in alternate embodiments such as, but not limited to, smaller airplanes, helicopters, etc. Furthermore, the loading and exit doors in alternate embodiments may be configured differently depending on the type of aircraft used. The present embodiment may be used in all weather conditions because smoke and wind do not affect the water in capsules 101. Because water capsules 101 keep the water from dispersing in the air, the higher the height from which water capsules 101 are dropped, the more effective they are. Also, the use of water capsules 101 enables users to combat fire faster so that the fire may not have time to get bigger and stronger. The present embodiment may also be used to combat fire in gasoline stations because it can offer a quick method of fighting the fire without putting firefighters at risk.

Figure 2:
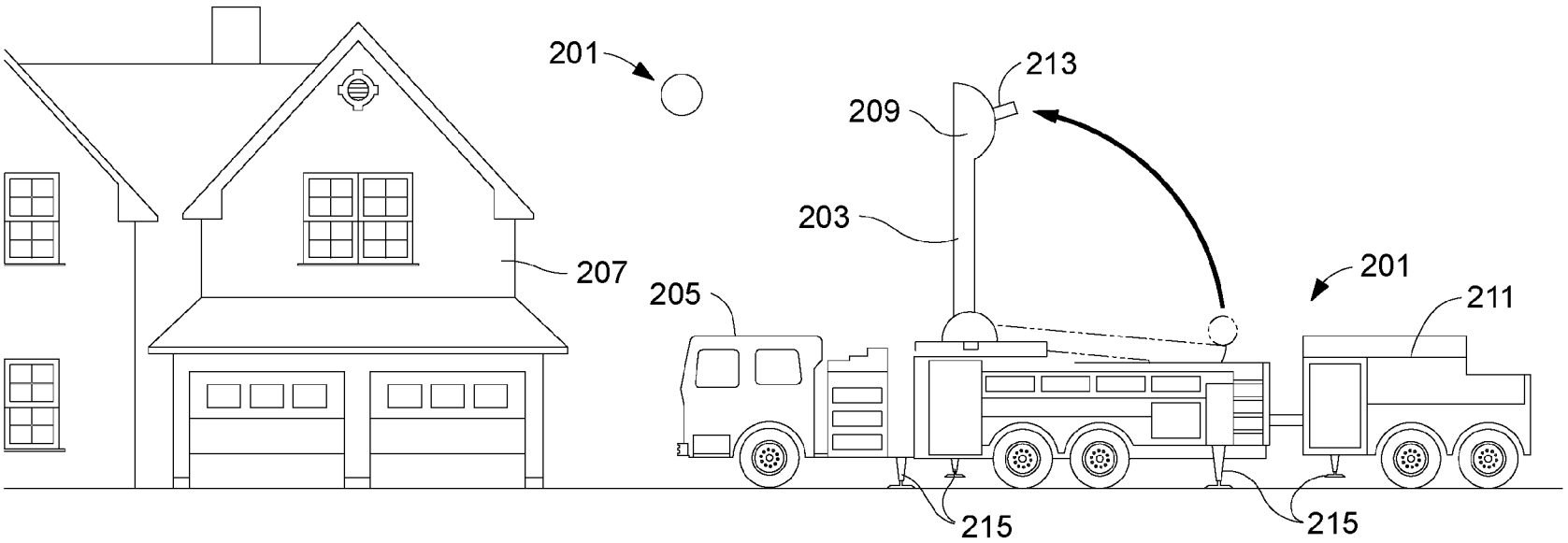
FIG. 2 is a diagrammatic side view of an exemplary fire fighting system for homes and other small buildings, in accordance with an embodiment of the present invention.

FIG. 2 is a diagrammatic side view of an exemplary fire fighting system for homes and other small buildings, in accordance with an embodiment of the present invention. This fire fighting system has the ability to combat fire outside and inside buildings. In the present embodiment, water capsules 201 are hurled from a spring-loaded arm 203 on a fire engine 205 at a building 207 and enter the windows of building 207 and explode, releasing the water onto the fire. In alternate embodiments the spring-loaded arm may be mounted to other types of vehicles or may be a stand-alone device. In the present embodiment, the operator loads capsules 201 into a capsule receptacle 209 at the end of spring-loaded arm 203 when in the lowered position and releases spring-loaded arm 203 to the upright position to hurl water capsules 201 at building 207. This enables the operator to fight the fire from a safe distance with lower risk. Additional water capsules may be located in a storage trolley 211 attached to the back of fire engine 205. In the center of capsule receptacle 209, a high powered light 213 can indicate where water capsules 201 will be launched. Legs 215 may be extended from fire engine 205 and trolley 211 in order to stabilize spring-loaded arm 203 before use. In the present embodiment, spring-loaded arm 203 can be rotated to the right or to the left to aim. Furthermore, the present embodiment comprises a computer system to control the motion of spring-loaded arm 203 that requires a security code to operate. The computer system may also process data pertaining to the duration of use and the number of water capsules used. The computer system may also comprise a video system for added security. Operators of the present embodiment may require additional training on the proper use of the fire fighting system and the area where the system is to be used must be inspected to determine if there are any obstacles that may hinder the use of the system. The area is preferably closed and free of obstacles within 30 feet of fire engine 205.

Figure 3:
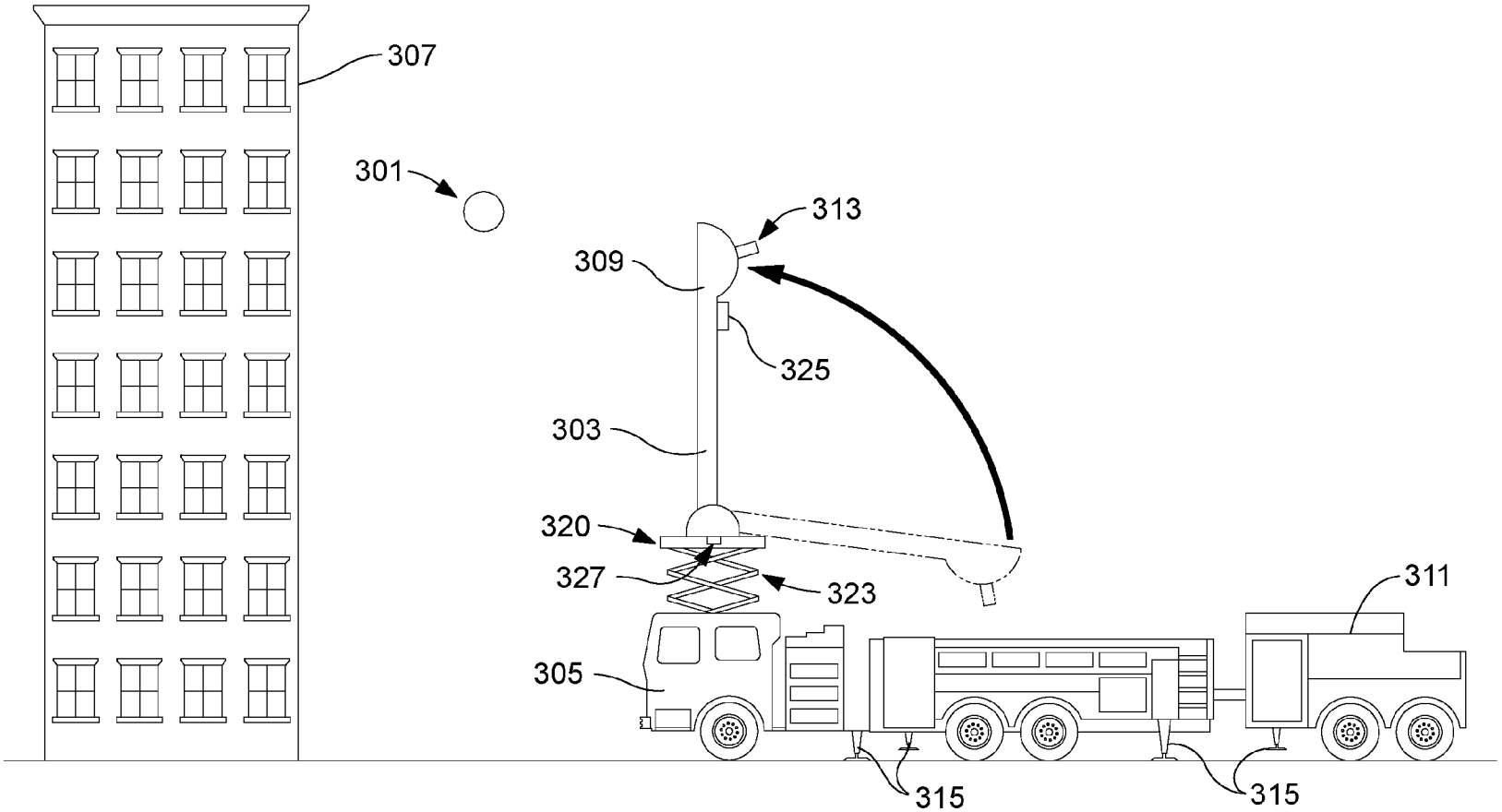
FIG. 3 is a diagrammatic side view of an exemplary fire fighting system for tall buildings, in accordance with an embodiment of the present invention.

FIG. 3 is a diagrammatic side view of an exemplary fire fighting system for tall buildings, in accordance with an embodiment of the present invention. This fire fighting system has the ability to combat fire both outside and inside buildings. In the present embodiment, water capsules 301 are hurled from a spring-loaded arm 303 on a fire engine 305 and enter the windows of a building 307 and explode, releasing the water onto the fire. In alternate embodiments the spring-loaded arm may be mounted to other types of vehicles or may be a stand-alone device. In the present embodiment, the operator loads capsules 301 into a capsule receptacle 309 at the end of spring-loaded arm 303 when in the lowered position and releases spring-loaded arm 303 to the upright position to hurl water capsules 301 at building 307. This enables the operator to fight the fire from a safe distance with lower risk. Additional water capsules may be located in a storage trolley 311 attached to the back of fire engine 305. Spring-loaded arm 303 also comprises a motor 325 to power movement. In the center of capsule receptacle 309, a high power light 313 indicates where water capsules 301 will be launched. Legs 315 may be extended from fire engine 305 and trolley 311 in order to stabilize spring-loaded arm 303 before use. The present embodiment comprises a height-adjustable platform 320 that is raised and lowered by a scissor mechanism 323. This enables spring-loaded arm 303 to be adjusted to a height appropriate for the building in which the fire is located. In the present embodiment, spring-loaded arm 303 can be rotated to the right or to the left by a motor 327 to aim. Furthermore, the present embodiment comprises a computer system to control the motion of spring-loaded arm 303 that requires a security code to operate. The computer system may also process data pertaining to the duration of use and the number of water capsules used. The computer system may also comprise a video system for added security.

Figure 4:
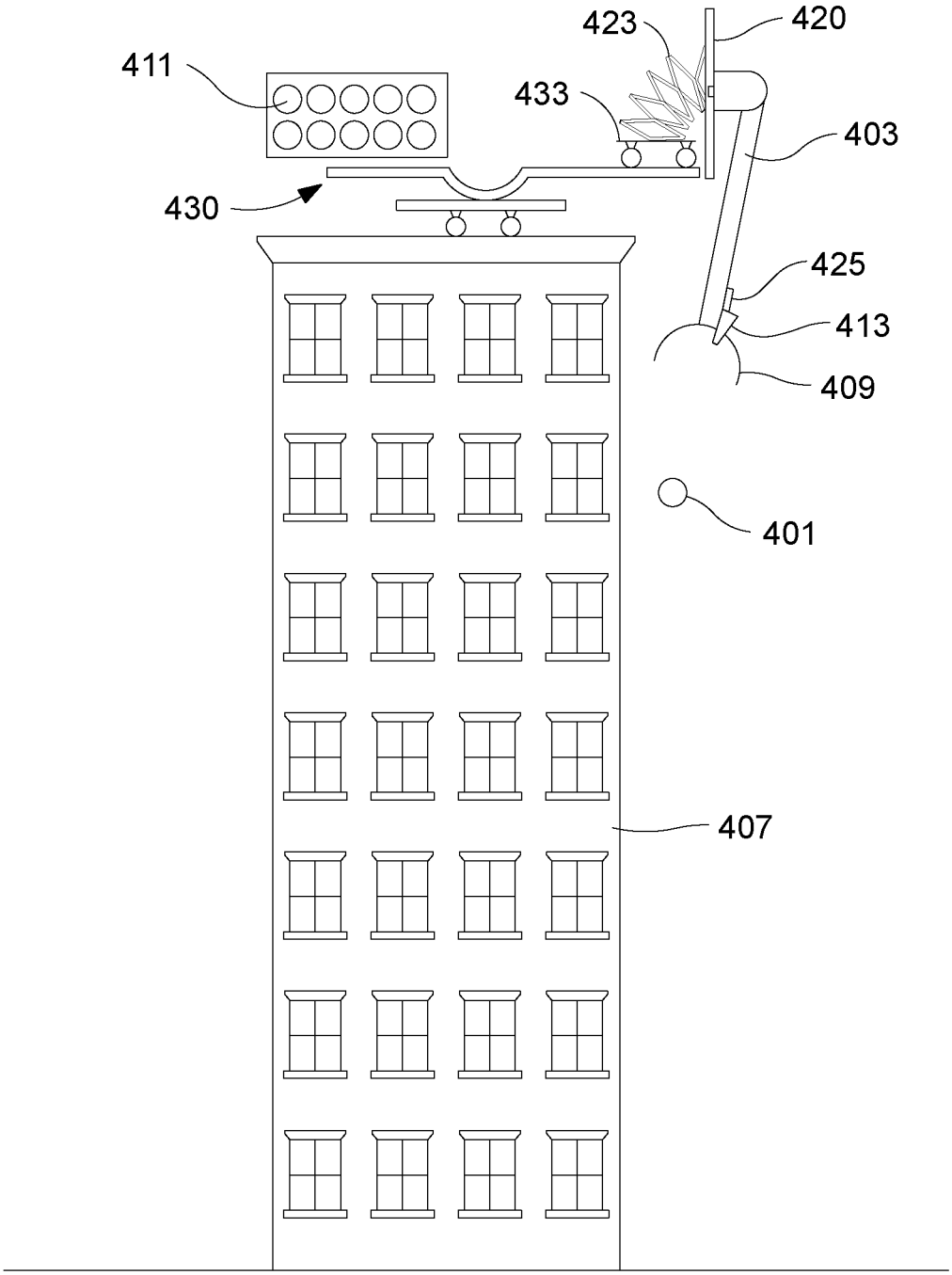
FIG. 4 is a diagrammatic side view of an exemplary fire fighting system mounted on the roof of a building, in accordance with an embodiment of the present invention.

FIG. 4 is a diagrammatic side view of an exemplary fire fighting system mounted on the roof of a building 407, in accordance with an embodiment of the present invention. This fire fighting system hurls water capsules 401 at a high velocity into the windows of building 407 where water capsules 401 explode and scatter the water on the fire. This system can combat fire quickly so the fire does not have an opportunity to build in strength and size, and the system is not affected by the weather or smoke in the area. In the present embodiment, water capsules 401 are loaded into a capsule receptacle 409 at the end of a spring-loaded arm 403 and spring-loaded arm 403 hurls water capsules 401 at building 407. Additional water capsules may be located in a storage receptacle 411 located behind spring-loaded arm 403. The present embodiment comprises a height-adjustable platform 420 that is raised and lowered by a scissor mechanism 423. Spring-loaded arm 403 also comprises a motor 425 that powers the movement of arm 403. In the present embodiment, spring-loaded arm 403 can be rotated to the right or to the left to aim. In the center of capsule receptacle 409 a high power light 413 is located to indicate where water capsules will be launched. Spring-loaded arm 403 can rotate to the right or to the left. Furthermore, the present embodiment comprises a computer system to control the motion of spring-loaded arm 403 that requires a security code to operate. The computer system may also process data pertaining to the duration of use and the number of water capsules used. The computer system may also comprise a video system for added security. In the present embodiment, the fire fighting system is on a rolling car 430 that enables the system to move about the roof. Furthermore, spring-loaded arm 403 is located on a cart 433 on a rail 435 that enables arm 403 to be extended past the edge of the roof to access lower portions of the building.

Buildings using roof-mounted fire fighting systems according to the present embodiment may comprise windows that are taller and wider so that the water capsules can more easily be aimed into the windows. Also the windows must be easily accessed by the system and cannot have obstacles in the line of fire of the water capsules such as, but not limited to, balconies, roofs, fire escapes, etc. Furthermore, buildings using the present embodiment must have a roof that is clear so that it can move to any area without any problems.

Figure 5:
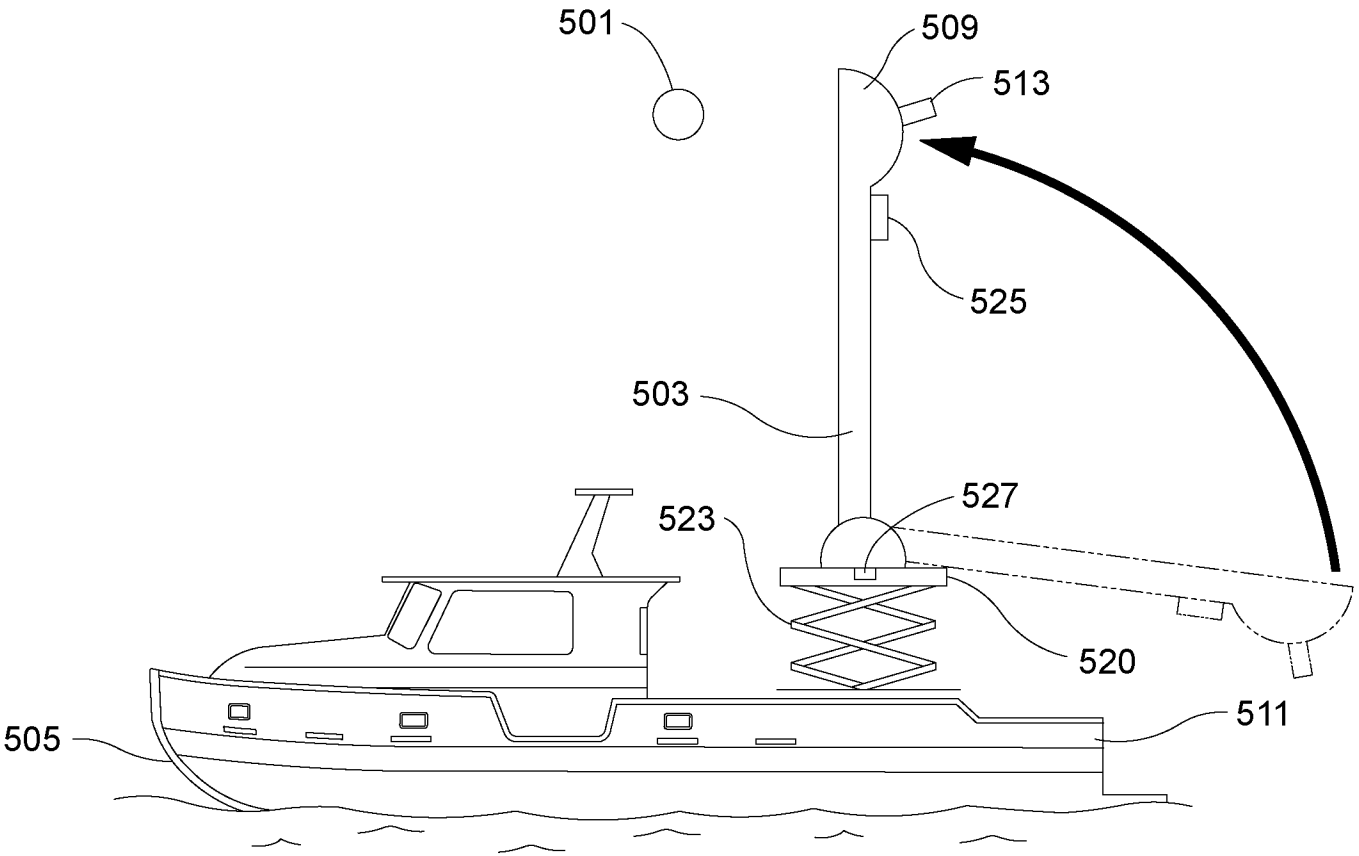
FIG. 5 is a diagrammatic side view of an exemplary system for fighting fires that is mounted on a boat, in accordance with an embodiment of the present invention.

FIG. 5 is a diagrammatic side view of an exemplary system for fighting fires that is mounted on a boat 505, in accordance with an embodiment of the present invention. This fire fighting system has the ability to combat fires on the water for example, without limitation on yachts, boats, piers, or waterside buildings. In the present embodiment, water capsules 501 are hurled from a spring-loaded arm 503 on boat 505 and enter the windows or area that is on fire and explode, releasing the water onto the fire. The operator loads capsules 501 into a capsule receptacle 509 at the end of spring-loaded arm 503 when in the lowered position and releases spring-loaded arm 503 to the upright position to hurl water capsules 501 at the fire. This enables the operator to fight the fire from a safe distance with lower risk. Additional water capsules may be located in a storage area 511 located in the back of boat 505. The present embodiment comprises a height-adjustable platform 520 that is raised and lowered by a scissor mechanism 523. Spring-loaded arm 503 also comprises a motor 525 to power movement. In the center of capsule receptacle 509, a high power light 513 indicates where the water capsules 501 will be launched. In the present embodiment, spring-loaded arm 503 can be rotated to the right or to the left by a motor 527 to aim. Furthermore, the present embodiment comprises a computer system to control the motion of spring-loaded arm 503 that requires a security code to operate. The computer system may also process data pertaining to the duration of use and the number of water capsules used. The computer system may also comprise a video system for added security.

Preferred embodiments of the present embodiment should not be used when people are in the capsule receptacle. Preferred embodiments should also not be used where people might get hurt or to hurl water capsules directly at people or other inappropriate objects. If using a preferred embodiment to launch water capsules at a structure where the fire has consumed everything, the capsules may destroy the structure where they are hurled depending on the impact of the water capsules.

Having fully described at least one embodiment of the present invention, other equivalent or alternative methods of providing fire fighting means and methods using water capsules according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus consisting of:

a transport vehicle;

at least one capsule, said at least one capsule being configured to transport a quantity of water to a vicinity of a fire and substantially carrying said water to said fire, in which said at least one capsule hurled to said fire substantially breaks open on contact with said fire releasing said water;

a spring-loaded arm, said spring-loaded arm comprises at least one capsule receptacle into engagement at a distal end of said spring-loaded arm, wherein said at least one capsule being configured to be loaded in said capsule receptacle, in which said capsule receptacle being configured for accepting said at least one capsule in a generally lowered or horizontal position, wherein said spring-loaded arm being configured for releasing said at least one capsule to be substantially carried to said fire in a generally upright or vertical position, wherein said spring-loaded arm substantially rotating from said generally lowered or horizontal position, in which said at least one capsule is substantially positioned on said capsule receptacle at a distal end of said spring-loaded arm, to said generally upright or vertical position wherein said at least one capsule is released;

said spring-loaded arm further comprising a high powered light indicating where said at least one capsule will be launched;

said spring-loaded arm further comprises at least a first motor, said first motor being configured to substantially power motion of said spring-loaded arm;

a height-adjustable platform, wherein said height-adjustable platform being configured to adjust a height of said spring-loaded arm to a generally appropriate height for a building in which said fire is located, in which said height-adjustable platform comprises at least a second motor, wherein said second motor being configured to rotate said spring-loaded arm to the right or to the left to aim; and a computer system, in which said computer system into engagement with said motor being configured to control said motion of said spring-loaded arm, wherein said computer system further being configured to process a duration of operating said spring-loaded arm and number of said at least one capsule hurled to said fire, in which a security code being configured to require operation of said spring-loaded arm.

2. The apparatus as recited in claim 1, wherein said transport vehicle transporting said at least one capsule to said vicinity of said fire.

3. The apparatus as recited in claim 2, wherein said transport vehicle is a fire engine, said fire engine comprises stabilizing legs being configured to extend to substantially stabilize said spring-loaded arm.

4. The apparatus as recited in claim 3, in which said fire engine further comprising a trolley into engagement with a distal end of said fire engine, wherein said trolley being configured for storage and transport of at least two or more of said at least one capsule.

5. An apparatus consisting of:

a transport vehicle;

at least one capsule, said at least one capsule being configured to transport a quantity of water to a vicinity of a fire and substantially carrying said water to said fire, in which said at least one capsule hurled to said fire substantially breaks open on contact with said fire releasing said water;

a spring-loaded arm, said spring-loaded arm comprises at least one capsule receptacle into engagement at a distal end of said spring-loaded arm, wherein said at least one capsule being configured to be loaded in said capsule receptacle, in which said capsule receptacle being configured for accepting said at least one capsule in a generally lowered or horizontal position, wherein said spring-loaded arm being configured for releasing said at least one capsule to be substantially carried to said fire in a generally upright or vertical position, wherein said spring-loaded arm substantially rotating from said generally lowered or horizontal position, in which said at least one capsule is substantially positioned on said capsule receptacle at a distal end of said spring-loaded arm, to said generally upright or vertical position wherein said at least one capsule is released;

said spring-loaded arm further comprising a high powered light indicating where said at least one capsule will be launched;

said spring-loaded arm further comprises at least a first motor, said first motor being configured to substantially power motion of said spring-loaded arm;

a height-adjustable platform, wherein said height-adjustable platform being configured to adjust a height of said spring-loaded arm to a generally appropriate height for a building in which said fire is located, in which said height-adjustable platform comprises at least a second motor, wherein said second motor being configured to rotate said spring-loaded arm to the right or to the left to aim; and a computer system, in which said computer system into engagement with said motor being configured to control said motion of said spring-loaded arm, wherein said computer system further being configured to process a duration of operating said spring-loaded arm and number of said at least one capsule hurled to said fire, in which a security code being configured to require operation of said spring-loaded arm.

6. The apparatus as recited in claim 5, in which said height-adjustable platform further comprises a scissor mechanism being configured to raise or lower said height-adjustable platform substantially adjusting a height of said spring-loaded arm.

* * * * *